US008850612B1

(12) United States Patent
Perciballi

(10) Patent No.: US 8,850,612 B1
(45) Date of Patent: Oct. 7, 2014

(54) BALLISTIC HELMET AND FABRICATION METHOD

(75) Inventor: William J. Perciballi, Phoenix, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 95 days.

(21) Appl. No.: 13/595,639

(22) Filed: Aug. 27, 2012

Related U.S. Application Data

(60) Provisional application No. 61/530,284, filed on Sep. 1, 2011.

(51) Int. Cl.
*A41H 1/04* (2006.01)
*F41H 1/02* (2006.01)
*F41H 1/04* (2006.01)

(52) U.S. Cl.
CPC ... *F41H 1/04* (2013.01); *F41H 1/02* (2013.01)
USPC ..... 2/2.5; 428/36.3

(58) Field of Classification Search
USPC ..... 2/2.5, 6.6, 6.8, 410, 411, 416, 425, 909; 89/36.05; 428/36.1, 36.3, 911
See application file for complete search history.

(56) References Cited

U.S. PATENT DOCUMENTS

| | | | | |
|---|---|---|---|---|
| 2,532,442 | A | | 12/1950 | Daly |
| 3,005,256 | A | | 10/1961 | Young |
| 3,047,191 | A | | 7/1962 | Young |
| 3,320,619 | A | * | 5/1967 | Lastnik et al. ..... 2/6.6 |
| 3,486,655 | A | | 12/1969 | Ragetili |
| 3,819,461 | A | | 6/1974 | Saffadi |
| 3,958,276 | A | * | 5/1976 | Clausen ..... 2/2.5 |
| 4,023,209 | A | * | 5/1977 | Frieder et al. ..... 2/6.6 |
| 4,199,388 | A | | 4/1980 | Tracy et al. |
| 4,453,995 | A | | 6/1984 | Morrisey |
| 4,473,208 | A | | 9/1984 | Nava |
| 4,594,122 | A | | 6/1986 | McConnell |
| 4,596,056 | A | | 6/1986 | Grick |
| 4,681,049 | A | | 7/1987 | Vees et al. |
| 4,778,638 | A | | 10/1988 | White |
| 4,785,956 | A | | 11/1988 | Kepler et al. |
| 4,953,234 | A | | 9/1990 | Li et al. |
| 5,035,952 | A | | 7/1991 | Bruinink et al. |
| 5,776,838 | A | | 7/1998 | Dellinger |
| 6,086,968 | A | * | 7/2000 | Horovitz ..... 428/36.1 |
| 6,107,220 | A | | 8/2000 | Popper et al. |
| 7,228,571 | B2 | | 6/2007 | Cheese |
| 7,708,852 | B2 | * | 5/2010 | Busch ..... 156/93 |
| 7,820,565 | B2 | * | 10/2010 | van Heerden et al. ..... 442/134 |
| 2011/0167545 | A1 | | 7/2011 | Garcia et al. |

* cited by examiner

*Primary Examiner* — Tejash Patel

(74) *Attorney, Agent, or Firm* — James L Farmer

(57) ABSTRACT

Methods and apparatus are provided for a seamless ballistic resistant helmet. In one exemplary embodiment the helmet comprises high performance fibers consolidated with a matrix material and arranged in a plurality of substantially seamless layers.

9 Claims, 10 Drawing Sheets

Fig. 11
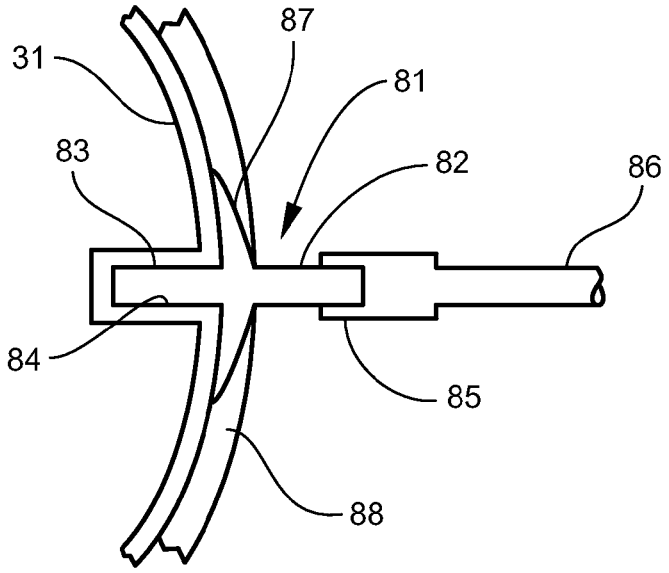
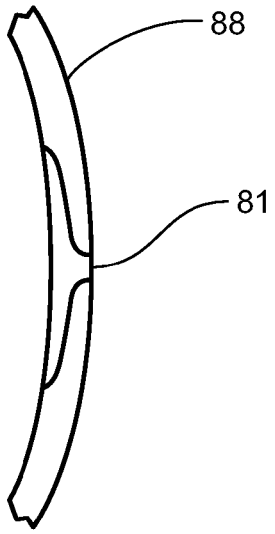
Fig. 12

BALLISTIC HELMET AND FABRICATION METHOD

TECHNICAL FIELD

The instant invention relates to ballistic resistant helmets and methods of manufacturing ballistic resistant helmets.

BRIEF DESCRIPTION OF THE DRAWINGS

In the accompanying drawings:

FIG. 11 depicts a sacrificial composite axle that becomes part of the filament wound shell;

FIG. 12 depicts the filament wound shell of FIG. 11 removed from the mandrel with the ends of the sacrificial axle trimmed flush.

DESCRIPTION OF THE EMBODIMENTS

Figure 1:
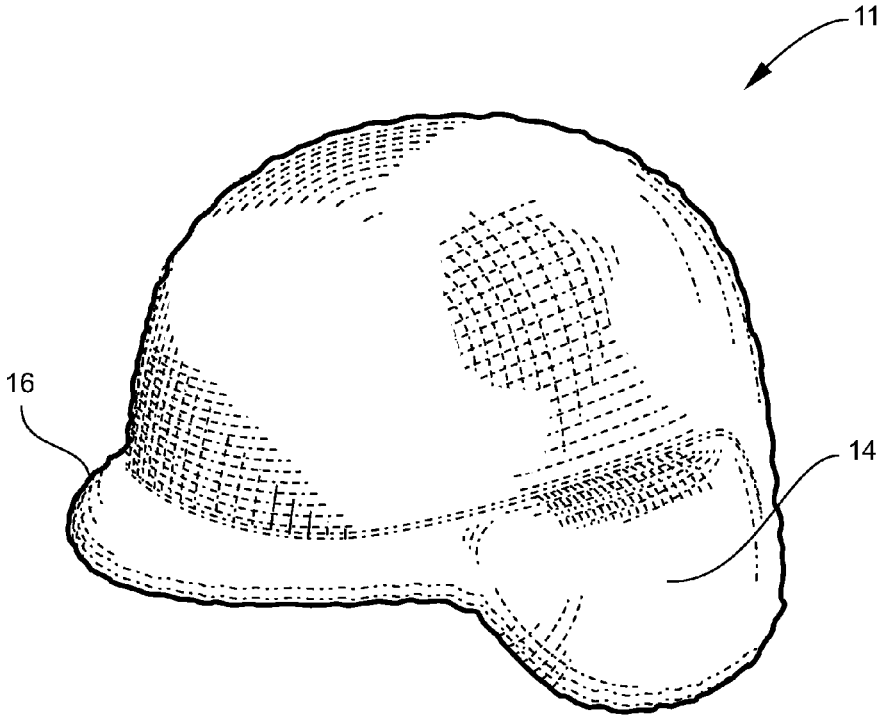
FIG. 1 is a perspective view of a layer of high performance fibers knitted in the general shape of a helmet.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Terms such as "connected" or "attached" as used herein are intended to denote direct, indirect (with intermediate elements), rigid, and flexible linking arrangements, as well as linking arrangements with one or more degrees of freedom.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

A ballistic resistant helmet in accordance with the present disclosure comprises a composite that may include one or more substantially seamless and uniform layers of a ballistic resistant material. The one or more ballistic resistant material layers may incorporate so-called high performance fibers including, for example, carbon and graphite fibers; S-glass composed of silica ($SiO_2$), alumina ($Al_2O_3$), and magnesia (MgO); aramid fibers, such as commercially-known Twaron®, Technora®, Heracron®, and DuPont's Kevlar®29, Kevlar® 49, Kevlar® 129, and Kelvar® KM2; high molecular weight polyethylene (HMWPE), such as commercially-known Spectra® and Dyneema®; polybenzobisoxazole (PBO) fibers, such as commercially-known Zylon®; and polypyridobisimidazole (PIPD), such as commercially-known M5®. These fibers have high tensile strength, elastic modulus, and strain to failure. For example, such fibers may have a tensile strength greater than about 2000 MPa and an elastic modulus greater than about 60 GPa. Exemplary composites incorporating such high performance fibers may offer increased penetration resistance and stiffness compared to other fiber based composites, and may improve back-face deformation and edge impact for multi-hit ballistic protection.

Various constructions may be employed in a ballistic resistant helmet according to the present disclosure. In a first exemplary embodiment, a ballistic resistant helmet comprises one or more preformed layers of a high performance fiber that has been knitted in the general or exact shape of the helmet. The helmet shaped layers may be produced using various known textile manufacturing techniques for creating circular and dome-shaped knitted articles, such as knitting in the round, and any of various knit types such as warp, weft, cable, and double knit, to name a few. Various degrees of elasticity may also be incorporated in the knit construction as may be required for a particular assembly or molding process. One example of a relatively stretchable commercially available product is a Kevlar® simplex knit fabric sold by SSM Industries under the product designation SSM 63940.22. Such knitted, stretchable, high performance materials may also be selected for compliance with relevant military standards, such as U.S. Navy MIL-C-81393B (Cloth, Knitted, Polyamide, High Temperature Resistant, Simplex, Jersey).

The knitted layers may be constructed with varying degrees of conformance to the exact shape of the final article. For example, in one exemplary embodiment a knitted layer is formed in substantially the exact shape of the helmet using a relatively inelastic knit construction. Referring to FIG. 1, such a knitted layer 11 intended to substantially match the helmet shape may incorporate detailed shape elements such as the ear bulges 14 and brim 16 found on many ballistic resistant combat helmets. Alternatively, the knitted layers may be formed in the general shape of the helmet using a relatively elastic knit, relying more on stretch during a layup or molding process to obtain the exact contour and features such as ear bulges and brims. For example, a knitted layer may be constructed in a simple dome shape that is slightly smaller than the finished article, yet readily conformable to the size and contours of the particular design.

The preformed knitted layers may be formed into a multilayer shaped hard composite using various known wet or dry methods. Such methods may include for example, wetting the individual layers with a suitable epoxy or polyester resin, or applying a dry thermoplastic or thermoset adhesive, either to the fibers before knitting, or between knitted layers in sheet or scrim form. The knitted layers with wet or dry adhesive may then be transformed into a solid composite using any of various known processes, such as autoclaving, or compression molding. For example, dry knitted layers with pre-applied thermoplastic or thermoset adhesive may be stacked between halves of a compression molding apparatus, and pressed under sufficient heat and pressure to consolidate and cure the layers into a solid composite. Several examples of suitable processes for solidifying stacks of high performance ballistic layers with heat and pressure are disclosed in U.S. Pat. Nos. 5,437,905, 5,635,288, 5,935,678, 5,443,883, 5,547,536, 7,549,366, 7,845,265, all of which are assigned to the owner of the present invention. Alternatively, a consolidation or molding process may use a flexible membrane such as a vacuum bag or similar device to compress the stacked layers against a positive or negative mold during cure. An example of molding device using a flexible bladder to press a composite helmet layup against a negative mold of the outer surface of a helmet is disclosed in U.S. Pat. No. 2,532,442. The entire contents of this patent and the other molding related patents cited above are all hereby incorporated by reference.

Figure 2:
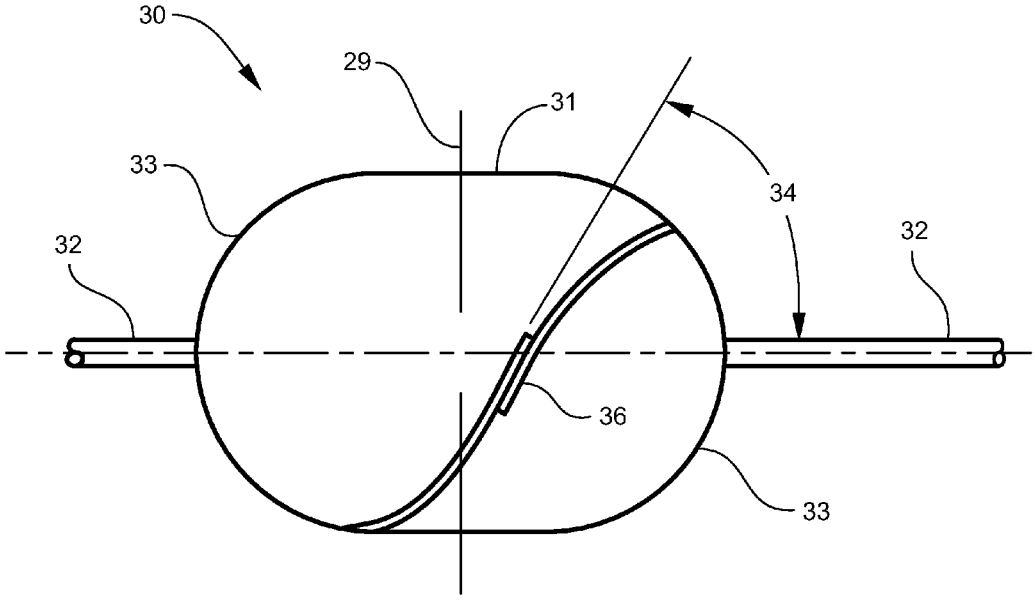
FIG. 2 is an illustration of a helmet filament winding apparatus in accordance with the present disclosure.

In a second exemplary embodiment, a ballistic helmet comprises multiple layers of wound unidirectional high performance fibers. A filament winding process similar to conventional processes for making filament wound pressure vessels may be employed to produce a filament wound helmet in accordance with this embodiment. Referring now to FIG. 2, an exemplary filament winding apparatus 30 comprises a mandrel 31 rotationally supported about a longitudinal axis by axles 32, and a laterally moveable filament guide carriage (not shown). The filament guide carriage may be a single axis type adapted for lateral reciprocating movement, or a multi-axis type with up to six degrees of freedom. The mandrel 31 comprises ends 33 on either side of a parting line 29 that present the general or exact shape of the finished helmet article. For example, an end 33 designed to replicate the exact helmet shape may include features such as a brim, and bulged ear portions.

Figure 3:
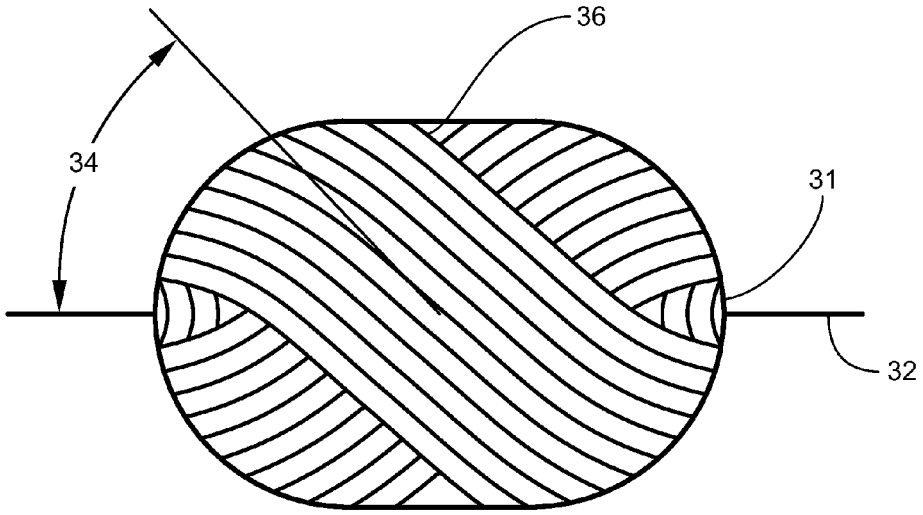
FIG. 3 is an illustration of a helical winding process applied to the helmet shaped mandrel portion of the winding apparatus of FIG. 2.

The filament winding apparatus may be operated to continuously wind sequential adjacent rows 36 of high performance fibers onto the mandrel 31 in multiple overlapping layers using various known filament winding techniques. Referring to FIG. 3, the result of a helical winding process is illustrated wherein each row 36 of high performance fibers wraps around mandrel 31 along a helical path at a wrap angle 34 defined by the relative motions of the mandrel and filament guide carriage. A row 36 may comprise a single fiber, strand, or tow, or multiple adjacent fibers or tows that are dispensed independently or on a film backing in tape form. The adjacent fiber rows advance around the mandrel in overlapping layers such that the filaments of each layer are at an angle to the fibers of the immediately underlying layer determined by the wrap angle 34 as shown.

Figure 4:
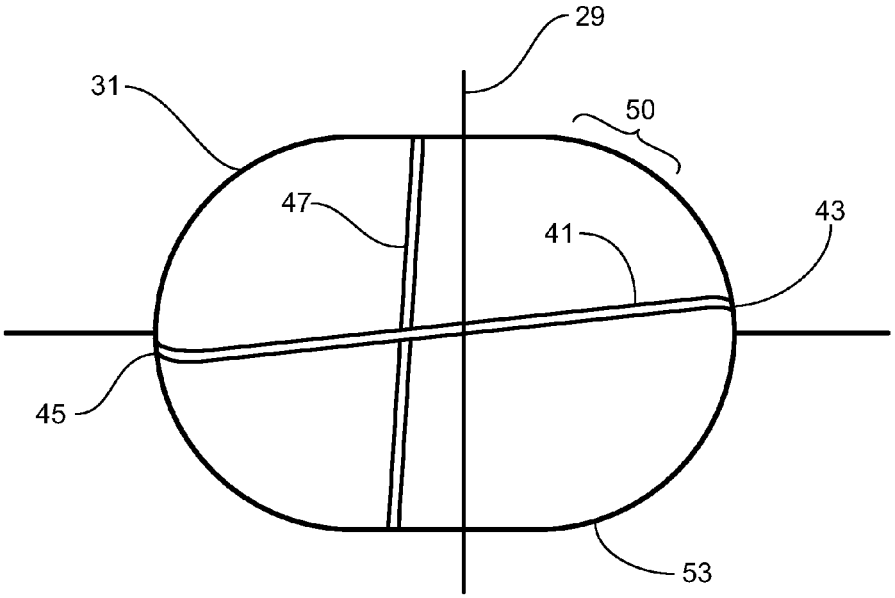
FIG. 4 is another depiction of the helmet shaped mandrel portion of the winding apparatus of FIG. 2 showing low and high wrap angles.

Moreover, the wrap angle 34 determines the general type of wrapping process. At one extreme, a process in which the fibers are wrapped at a very low wrap angle is often referred to as a polar wrapping process. A well known example of a polar wrapping process is a typical ball of string, where the string is wrapped in a nearly axial direction from one end of the ball to the other. In FIG. 4, a fiber 41 on mandrel 31 is at a very low wrap angle, extending in a principally longitudinal direction between turning points 43, 45 near the apex of each end 33 in the manner of a polar winding process. In a true polar process each loop of fiber goes around both ends of the mandrel.

At the other extreme, a process in which the fibers are wrapped at a very high wrap angle is often referred to as a hoop, or circumferential winding process. Hoop winding processes are often employed as reinforcement on cylindrical articles such as cylindrical pressure vessels and golf club shafts. In a hoop winding process the fibers are wrapped circumferentially in adjacent coils, each loop advancing axially along the mandrel by the thickness of the fiber row. Referring again to FIG. 4, a fiber 47 is oriented at a very high wrap angle, extending in a principally circumferential direction to produce a hoop winding pattern.

Figure 5:
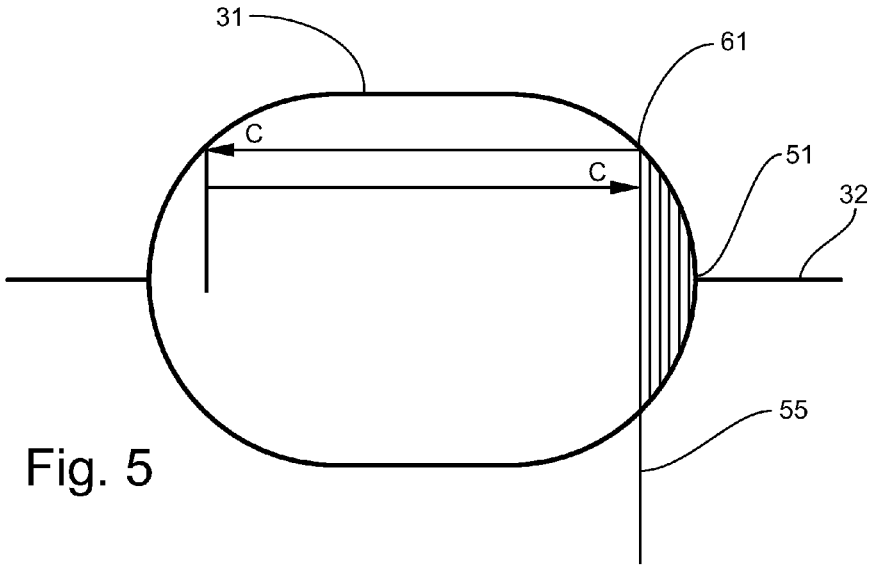
FIGS. 5 and 6 illustrate one embodiment of a partially completed hoop winding process applied to the helmet shaped mandrel.
Figure 6:
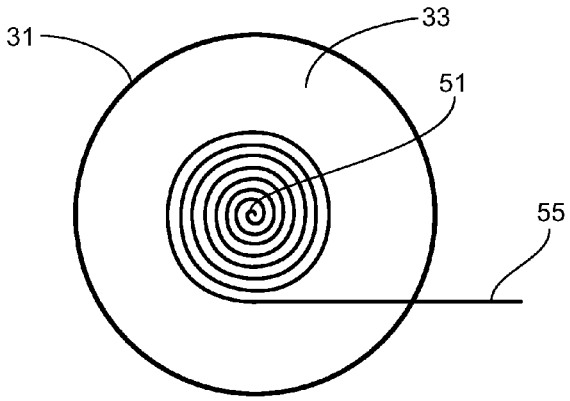

FIGS. 5 and 6 illustrate such a fiber 55 applied to mandrel 31 in a purely hoop process, beginning at the apex 51 and winding outward and around end 33 in a spiral fashion. In such a process the mandrel end 33, or the fiber 55, or both may be pretreated with a resin or other tackifying agent to prevent slippage due to the increasingly non-tangent wrap angles approaching the apex 51 of end 33. A helical winding process such as illustrated in FIG. 3 falls somewhere between the polar and hoop processes exemplified in FIGS. 4-6.

The wrap angle 34 may also be varied during the wrapping process instead of staying constant. For example, the wrap angle may be continuously or incrementally varied from a very low angle such as 1 or 2 degrees, to a very high angle such as 88 or 89 degrees. Such variations in the wrap angle 34 may be used to vary the layer to layer fiber crossover angles, as well as to preferentially define and vary the fiber density distribution about the ends 33. For example, the fiber density near a perimeter portion of end 33, as indicated at numeral 50 on FIG. 4, may be increased by increasing the dwell time at higher wrap angles relative to lower wrap angles, and vice versa. Such variation cycles may be employed once or multiple times in a helmet winding operation.

Similarly, the turnaround point may also be varied during a helmet winding operation. Referring still to FIG. 4, the turnaround point may be continuously or incrementally varied from a point near the apex of the mandrel such as point 43, to a point near the perimeter of the curved portion of the mandrel such as point 53. In one such variation scheme the fibers may be wrapped in a tangential manner such that a substantially polar wrap is obtained using turnaround point 43, and a substantially circumferential wrap is obtained using turnaround point 53. Thus, varying the turnaround point in a wrapping process where the fiber is continuously maintained at a tangent to the mandrel surface has the effect of simultaneously varying the wrap angle.

In another variation, the fibers may be wrapped in a substantially non-tangential direction such as that depicted in FIGS. 5 and 6, while the turnaround point is varied. By not forcing a tangential fiber direction, the turnaround point, and the amount of uncovered crown portion of the mandrel can thus be varied independently of the wrap angle. For example, referring to FIG. 5, the spiral wrap could be started at point 61 instead of point 51, and continue to a corresponding point at the opposite end of the mandrel before reversing direction and wrapping a second layer back to point 61, as indicated generally by the arrows labeled 'C'.

Figure 7:
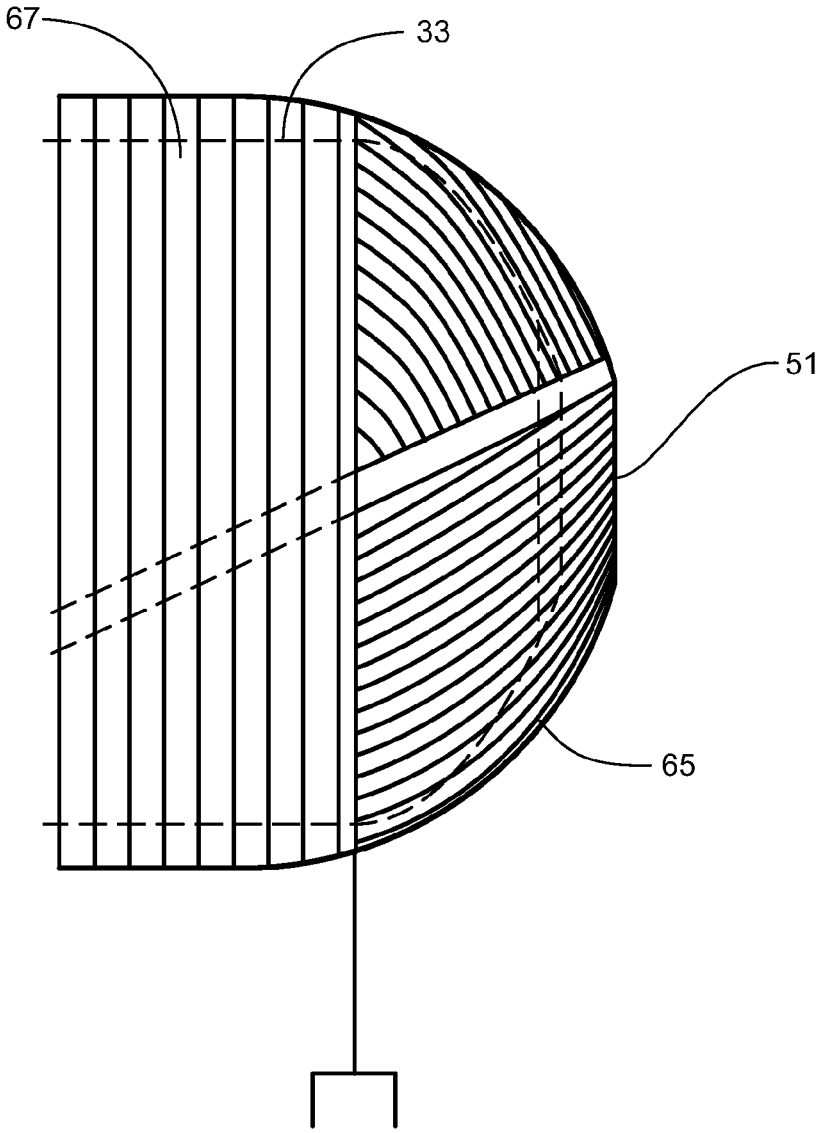
FIG. 7 depicts a portion of mandrel with a layer of hoop fibers overlaying a layer of helical fibers.

In addition, the above described fiber wrapping processes may be combined or varied from layer to layer. For example, FIG. 7 illustrates one end 33 of a helmet winding mandrel comprising a first layer 65 wrapped in a substantially helical manner, and a partially completed second, overlying layer 67 wrapped in a substantially circumferential manner. The first layer 65 may be the result of a wrapping process in which one or both of the winding angle and turnaround point were held constant. Similarly, the illustrated second layer 67 is intended to represent a uniformly circumferentially wound layer that may continue partially or completely around the curve of end 33 to the apex 51.

A filament winding process in accordance with the present disclosure may be automatically controlled at the direction of a controller executing a set of computer generated, machine readable instructions. One such computer (NC) controlled filament winding software system is commercially available from Crescent Consultants Limited of Kegworth England under the trade name Cadfil®. A system such as Cadfil® may be used to create a model of a helmet shaped mandrel, and simulate any of the above described helmet winding processes or combinations of processes. For example using Cadfil, machine positions can be displayed in 3D around a mandrel model or, in addition, a machine fiber dispensing head can be defined using brick and cylinder solid shapes, and a full 3D animation performed, including all machine motions such as eye roll and eye yaw. Having defined a mandrel shape and filament winding process, the last stage of program generation is post-processing where the defined fiber path is converted to machine readable winding instructions.

Figure 8:
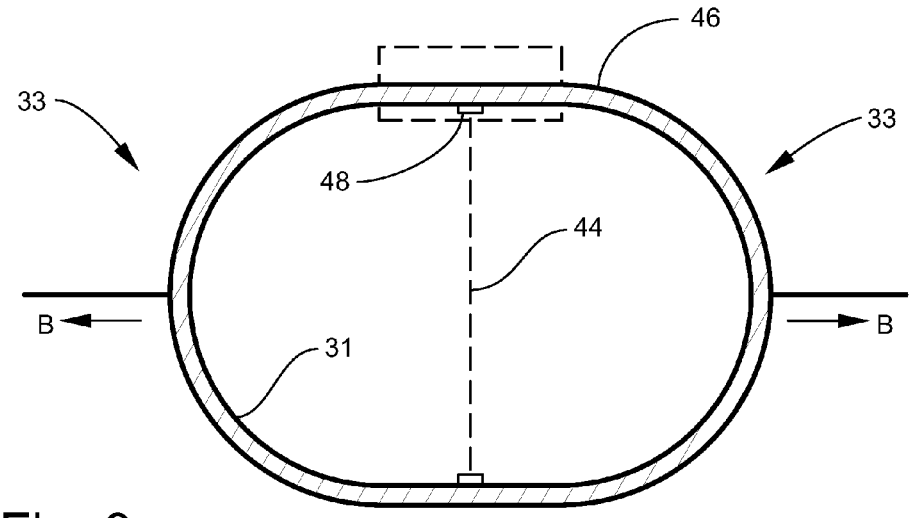
FIG. 8 depicts a circumferential cut line for separating a wound shell into two helmet shaped halves.

The wound fibers of the present embodiment may be applied wet or dry, with various post winding consolidation and/or curing processes. In one exemplary process, the fibers are pre-wetted with resin during the winding process in a manner similar to that used for winding pressure vessels. Referring to FIG. 8, multiple layers are wound onto the mandrel 31 until a helmet shaped composite shell 46 of desired thickness and fiber geometry is formed at each end 33 of mandrel. Once cured, each end of the composite shell 46 comprises one helmet. Alternatively, in a dry winding process, fibers are wound onto the mandrel with dry adhesives such as thermoplastics or thermosets, either pre-applied or applied during the winding process, and consolidated using any of the techniques described above in relation to the knitted layer embodiments. The composite shell may be removed by cutting the shell in half at dashed line 44, and then simply sliding the two halves off of each end of the mandrel in the directions indicated by arrows B.

Figure 9:
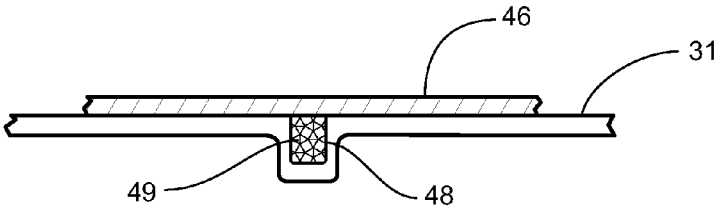
FIG. 9 is a detail view of a circumferential groove in the mandrel shaped to facilitate cutting of the wound shell.

The mandrel 31 may additionally include a circumferential groove 48 at the cut location, as shown in detail FIG. 9, to avoid damaging the mandrel with a cutting tool when the shell is cut in half. The groove 48 may be empty, with the wound fibers spanning the open groove, or the groove may be filled with a sacrificial material 49 such as plastic or foam for additional stability during the cutting process. In one embodiment the shell is cut in half by plunging a fixed cutting tool or saw into the shell at the groove location as the mandrel is rotated, much like a typical cutting operation on a lathe. With the shell halves removed from the mandrel, the cut edges may be further trimmed to give the exact desired shape of the helmet rim.

Figure 10:
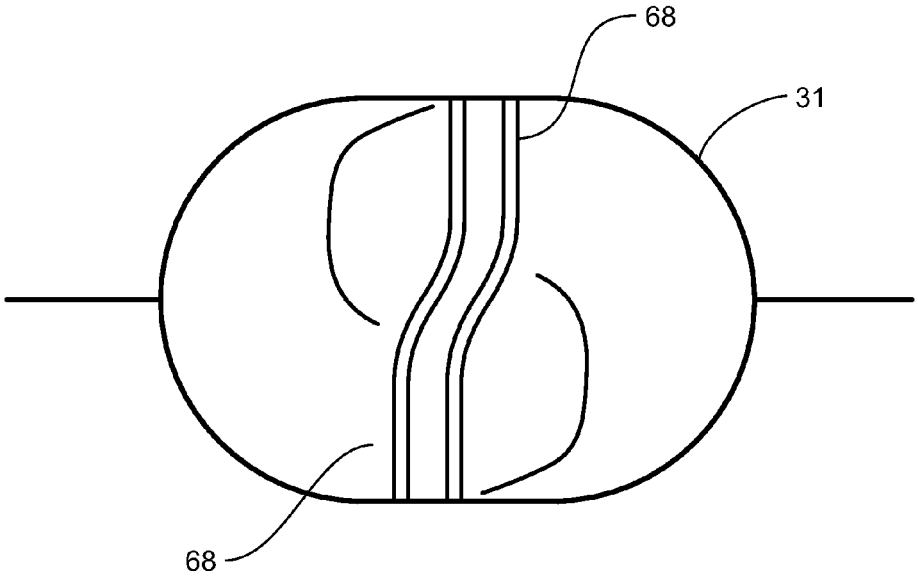
FIG. 10 depicts two grooves in the mandrel for cutting the wound shell along paths that coincide with the rim of each helmet.

Alternatively, a mandrel 31 may incorporate two grooves 68 as shown in FIG. 10, in the precise locations and profiles corresponding to the brim edges of the two helmets. In this embodiment two circumferential cuts are made around the mandrel with the cutting tool tracing each of the grooves 68. The present cutting process may also be performed in an automated fashion using a laterally moveable cutting tool applied to the rotating shell in a coordinated manner. The resulting shells removed from the mandrel ends in such a bi-directional cutting process are thus in the completed helmet shape, requiring no additional shaping along the edges.

Although filament winding processes have been described involving a mandrel supported for rotation on axles, alternative support arrangements are possible and contemplated in accordance with the present disclosure. For example, a helmet winding mandrel may be supported in a cantilevered manner by an axle at one end only. Winding processes adaptable to such a single axle support system are disclosed in U.S. Pat. No. 3,486,655, the contents of which are hereby incorporated by reference. Alternatively, a mandrel may be supported without any axles using an arrangement of rollers such as that disclosed in U.S. Pat. No. 4,453,995, the contents of which are also hereby incorporated by reference. Such support arrangements allow for use of a winding process on the axle-less mandrel ends that covers the entire crown of the mandrel all the way to the apex.

For mandrel ends that are supported by an axle, the area consumed by the axle results in an uncovered crown portion of the wound shell. The uncovered portion may be filled with a suitable plug material, such as for example chopped high performance fibers in a resin matrix. Alternatively, the axle itself may be of the same or similar composite materials comprising the wound shell, and become an integral part of the helmet shell. One such exemplary sacrificial axle 81 is illustrated in FIG. 11, comprising a first end 82 extending outward from helmet shaped mandrel 31, and a second end 83 extending toward mandrel 31 and into socket 84. The first end 82 may include threads or other connection means at a joint 85 for linking to a non-sacrificial axle extension 86. The second end 83 and socket 84 may have a spline, a key, or other means for transmission of torque between the axle 81 and mandrel 31. The sacrificial axle 81 may further include a crown portion 87 overlapping the outer surface of mandrel 31 around the axle. In a filament winding process, a wound fiber shell 88 is built up on the outside of mandrel 31 around the sacrificial axle 81, and overlaying the crown portion 87. Then upon removal of the completed helmet shells from the mandrel, the ends 82 and 83 of axle 81 may be trimmed off flush with the outer and inner surfaces of the shell as shown in FIG. 12.

Figure 13:
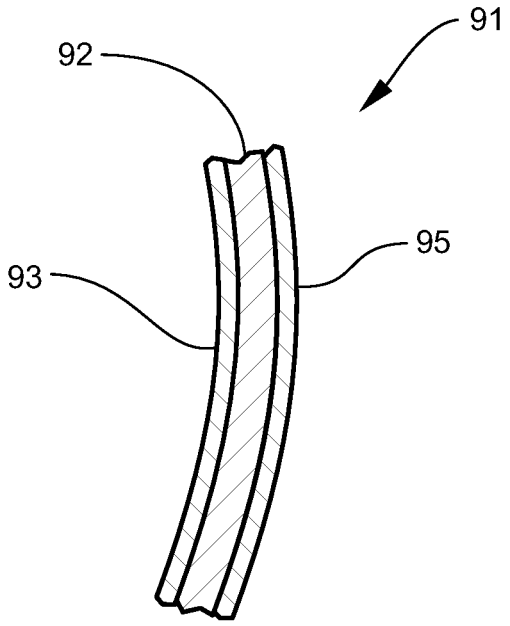
FIG. 13 is a cross-section of a portion of a helmet construction comprising knitted inner and outer layers with a filament wound core.

A helmet in accordance with the present disclosure may further comprise a combination of knit and wound layers. Referring now to FIG. 13, a seamless helmet construction 91 comprises a filament wound core 92, one or more knitted inner layers 93, and one or more knitted outer layers 94. Various combinations of the above described fabrication techniques may be employed to obtain the construction of FIG. 13. For example, in a first fabrication embodiment, one or more knitted inner layers 93 are pre-formed and consolidated in the shape of a helmet shaped mandrel, such as the previously described mandrel 31. The helmet shaped knitted mandrel may further include integral sacrificial axles extending from each end thereof. The wound filament core 92 may then be applied directly onto the knitted mandrel in a wet or dry process. If applied in a dry process, the core 92 may be partially or completely consolidated with heat and pressure using any of the above described methods. The wound core 92 may be covered with one or more knitted outer layers 94 in a wet or dry process, followed by further consolidation as required. The completed structure may then be cut apart along a parting line or helmet brim lines to give two helmets.

In another fabrication embodiment, a filament wound core 92 is formed on a mandrel 31 as previously described, and removed from the mandrel in two solid helmet shaped halves. Wet or dry layups of knitted inner layers 93 and outer layers 94 are then applied to each helmet shaped half. The helmet layups may then each be placed in a mold or autoclave for consolidation and curing of the inner and outer knitted layers, followed by edge trimming as needed. Those skilled in the art will recognize that the above described fabrication methods are by way of example, and that other variations are possible and certainly contemplated within the scope of the present disclosure.

A helmet manufactured in accordance with the present disclosure may afford several unique benefits. For example, gaps in ballistic protection capability due to discontinuities in the form of seams, joints, and splices in the fabric layers comprising the helmet structure are essentially eliminated. Further benefits may be obtained from the disclosed constructions and manufacturing methods in the form of extremely efficient use of materials, resulting in minimal scrap. In addition, cost of manufacturing may be substantially reduced over other, more complex or labor intensive systems through use of the above described constructions and automation methods. It should be noted that these benefits are by way of example only, and not intended to define or limit the scope of the present disclosure, or any embodiments disclosed therein in any way.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. An apparatus for producing a pair of filament wound helmet shaped composite shells, comprising:

an enclosed mandrel comprising two helmet shaped ends symmetrically disposed about a longitudinal axis extending through an apex of each end;

a channel circumscribing the mandrel between the two helmet shaped ends;

an axle extending outward from each end of the mandrel along the longitudinal axis; and a movable fiber dispensing head for winding high performance fibers onto the mandrel in a pre-defined manner.

2. The apparatus of claim 1, wherein the channel is filled with a sacrificial material.

3. The apparatus of claim 1, wherein the channel coincides with a brim edge of at least one of the helmet shaped ends.

4. The apparatus of claim 1, wherein the axles are adapted to become an integral part of the helmet shaped composite shells.

5. A method of producing a pair of filament wound helmet shaped composite shells, comprising:

providing a mandrel with two helmet shaped ends symmetrically disposed about a longitudinal axis extending through an apex of each end;

winding a plurality of layers of high performance fibers in conjunction with a matrix material onto the mandrel forming a two-ended shell by dispensing the high performance fiber from a movable fiber dispensing head while the mandrel is rotated;

curing the two-ended shell; and cutting the two-ended shell in half along a parting line between the two helmet shaped ends, and removing the two halves from each end of the mandrel.

6. The method of claim 5, wherein the parting line coincides with a brim edge of at least one of the helmet shaped ends.

7. The method of claim 5, wherein winding a plurality of layers of high performance fibers onto the mandrel forming a two-ended shell further comprises winding a plurality of layers with pre-defined fiber angles and coverage densities.

8. The method of claim 7, wherein winding a plurality of layers of high performance fibers onto the mandrel forming a two-ended shell is automatically controlled at the direction of a controller executing a set of computer generated instructions.

9. The method of claim 5, wherein the mandrel is supported for rotation without axles.

* * * * *